United States Patent [19]

Bishop

[11] Patent Number: 4,620,687

[45] Date of Patent: Nov. 4, 1986

[54] UNIVERSALLY POSITIONABLE BOOK HOLDER

[76] Inventor: John A. Bishop, Suite 4P, 343 E. 30th St., New York, N.Y. 10016

[21] Appl. No.: 559,737

[22] Filed: Dec. 9, 1983

[51] Int. Cl.[4] ..... A47B 97/04

[52] U.S. Cl. ..... 248/447.2; 248/451; 248/454

[58] Field of Search ..... 248/447.1, 447.2, 442, 248/442.2, 447, 448, 449, 451, 452, 453, 454, 499

[56] References Cited

U.S. PATENT DOCUMENTS

| | | | |
|---|---|---|---|
| 376,593 | 1/1888 | Greenwalt et al. | 248/447 |
| 411,493 | 9/1889 | Ducker | 248/451 |
| 431,036 | 7/1890 | Dawson | 248/454 |
| 2,807,908 | 10/1957 | Lykes | 248/451 |

FOREIGN PATENT DOCUMENTS

| | | | |
|---|---|---|---|
| 768 | of 1886 | United Kingdom | 248/451 |
| 525298 | 8/1940 | United Kingdom | 248/451 |

*Primary Examiner*—J. Franklin Foss

*Attorney, Agent, or Firm*—Christopher B. Garvey

[57] ABSTRACT

A universally positionable holder securely holds a book or other printed matter in any position. A selectively shaped back plate has a frontal lip at its lower portion and projecting pegs extending from a lower portion of the back plate. A plurality of spaced projecting pegs extend from the upper portion of the back plate. Hold-down stays are pivotably mounted near the top of the back plate and attachment means are provided on the back of the back plate. Elastic bands may be affixed to the lower pegs and stretchably secured across a book cover to any of the plurality of spaced projecting peg means extending from and along the upper portion of the back plate which is attached via a ball-joint to a universally positionable support arm comprised of arm segments and joints, mounted upon a base that may be mounted either by clamp or by screws.

6 Claims, 5 Drawing Figures

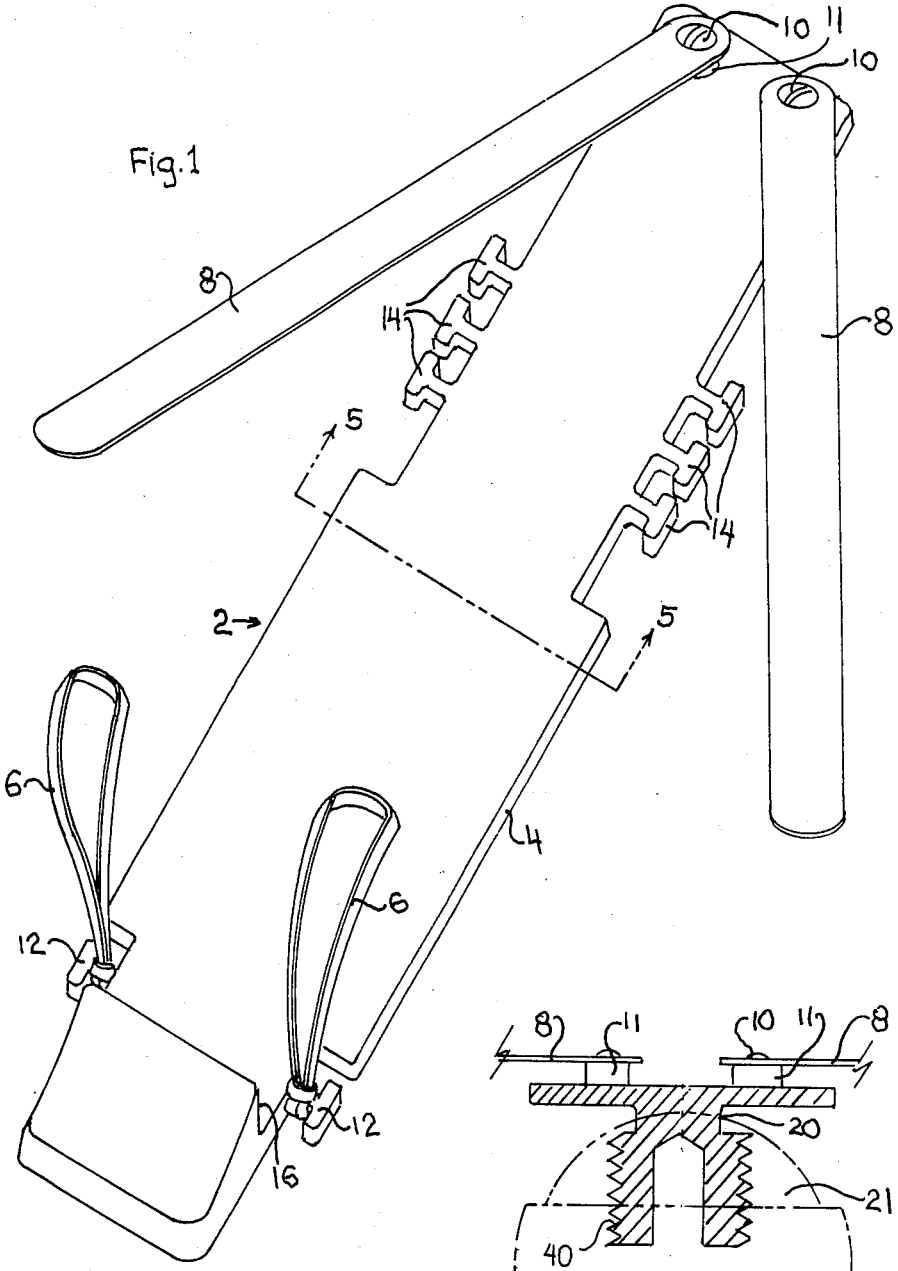
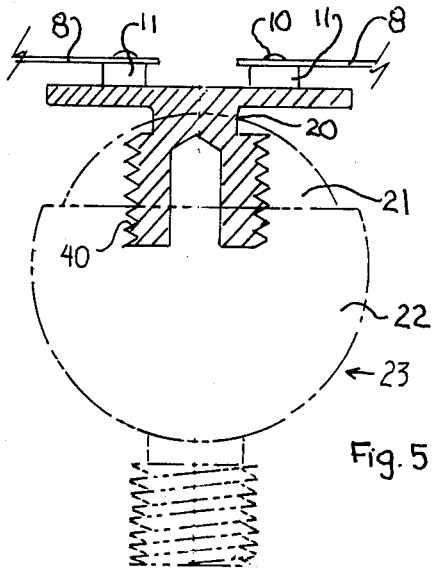
Fig. 5

UNIVERSALLY POSITIONABLE BOOK HOLDER

BACKGROUND OF THE INVENTION

The present invention relates to facilitating the reading process and allowing the user to free his or her hands and desk space for purposes other than holding the printed material. Stands for supporting printed matter are old in the art, for example, music stands, lecterns, and typing stands. The present invention provides a holder for printed matter which may be useful where a floor or desk surface is unavailable for supporting printed matter. Anyone who reads should find it useful.

SUMMARY OF THE INVENTION

To accomplish the foregoing and other objects of this invention there are three main parts to the invention. First, the part which attaches to the book, or other printed matter, holds the book securely from the cover or spine via two tightly strung elastic bands, shock cord or other elastic tensioning means. Two metal stays hold a book or other printed matter open at the desired page. The bands are held firm against a back plate of the invention by pegs near the bottom of the back plate and evenly spaced pegs along the upper portion of the back plate. The stays may be of metal such as spring steel and may be prebiased towards the back plate. One end of each stay is mounted on one of two pedestals projecting perpendicularly from the surface of the back plate. Said stays are secured upon their respective pedestals pivotably in a plane parallel to the back plate by means of fasteners such as screws or rivets which are capable of frictionally resisting but not preventing such pivotal movement of said stays. Said stays can be adjusted side to side to the desired angle for maximum effectiveness in stabilizing the open pages.

The back plate is held in place by a ball-joint which attaches to the back plate. The ball-joint allows rotation of the back plate in any direction and said joint may have provision to be adjusted for desired friction.

Said ball-joint is mounted upon an arm segment which is mounted rotatably about its own axis upon a joint. Said joint is pivotable in a plane containing the axis of the first arm segment and containing a second arm segment. Said joint is also rotatable about the axis of the second arm segment, thus giving the first arm segment the effect of being universally positionable with respect to the second arm. Said second arm is mounted rotatably about its own axis on a second joint. Said second joint provides a hinge pivotable in a single plane similarly to the first joint. Said joint is rotatably mounted on a base member which serves as a mounting means. Both first and second joints are frictionally adjustable to provide the desired resistance to pivoting.

The base member can be fastened to a wall via screws or to a suitable piece of furniture such as a desk, table or bed via a clamp.

BRIEF DESCRIPTION OF THE DRAWINGS

FIG. 1 is an oblique view of the back plate assembly.

FIG. 5 is a detail of the ball joint assembly showing the back plate in section.

DETAILED DESCRIPTION

Figure 4:
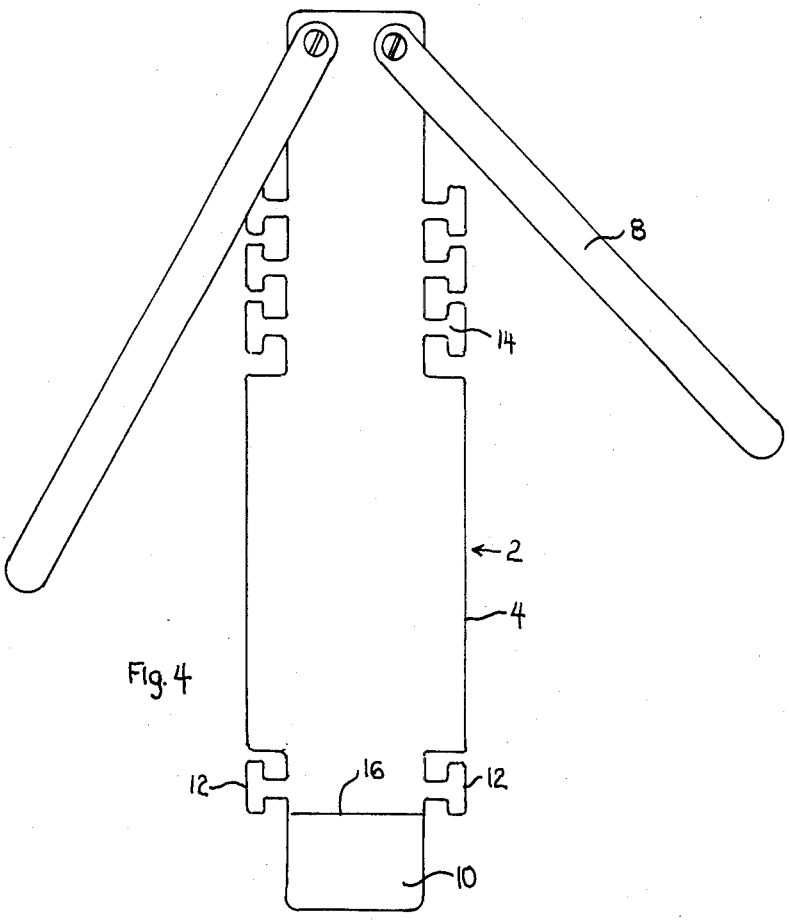
FIG. 4 is a front view of the back plate assembly.

FIG. 1 shows a back plate assembly, generally designated 2, of the present invention comprising a back plate 4, two fastening bands 6, two page hold-down stays 8, and two screws 10 which screw into pedestals 11 (shown better in FIGS. 2, 3 & 5) which attach the hold-down stays 8 to the back plate 4.

Located on the back plate 4 are 2 anchor pegs 12, projecting from the sides near the bottom of said back plate 4. Said pegs 12 are preferably integrally formed with the back plate 4 from which they project. Fastened to the pegs 12 are hold down bands 6, preferably rubber bands or straps or similar elastic material. Similarly, six or more adjustment pegs 14 project from near the top of backing plate 4, to provide for adjustment of the length of said bands 6 attachable thereto as may be appropriate for the particular size of the printed matter. These bands 6 may be stretched across the cover leaves of a book or the cover and several pages of a magazine to hold the book or magazine to the back plate 4. The back plate 4 also has a lip 16 at its bottom to prevent downslipping of the printed matter and to more securely hold the printed matter without any give due to the elasticity of the fastening bands 6. The fastening bands 6 are stretched between the cover and spine of the printed matter and then attached to the adjustment pegs 14 for a firm hold.

Figure 2:
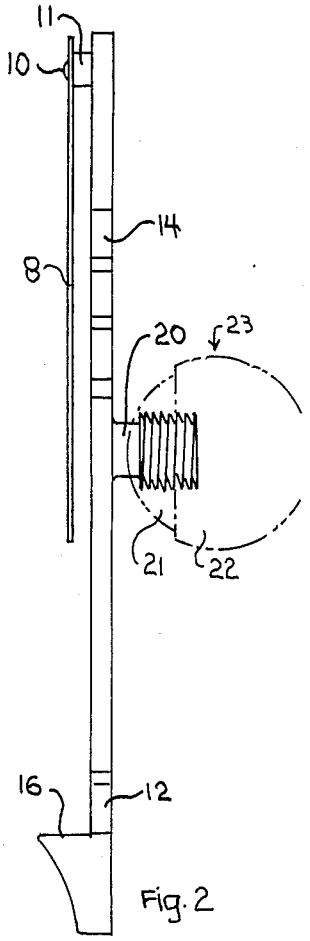
FIG. 2 is a side view of the back plate assembly.

FIG. 2 shows a side view to show the pedestals 11 which keep the hold down stays 8 elevated above the back plate and shows a truck 20 which is threaded to screw into a ball 21 which fits in a socket 22. Said ball 21 and socket 22 comprise a universal ball-joint 23.

Figure 3:
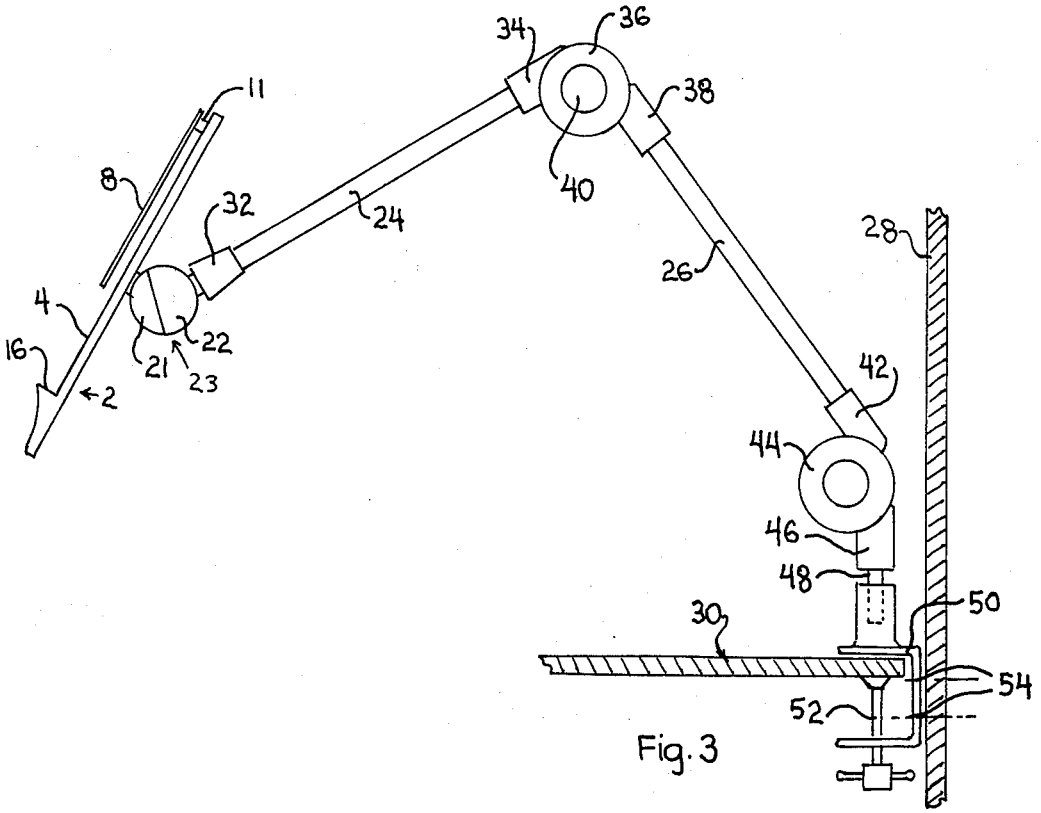
FIG. 3 is a side view of the entire invention.

FIG. 3 shows another side view which shows how the universal ball joint 23 is attached to arm segments 24, 26 which are then attached to a wall 28 or table top 30. The ball-joint 22 is attached to a collar 32 which is attached to an arm segment 24. The arm segment 24 is attached to swivel 34 which is attached to a friction-joint 36 attached to another swivel 38.

Said friction joint 36 is preferably frictionally adjustable by screw means 40.

Swivel 38 is rotatably attached to another arm segment 26, which is rotatably attached to another swivel 42, which is attached to a second friction joint 44, which is attached to another swivel 46. Swivel 46 is rotatably attached, possibly via post means such as 48, to a mounting means 50, which may comprise a standard clamp 52 for securing to a table top 30 or bed (not shown). Said mounting means 50 incorporates screw holes 54 for being secured to a wall 28 or other solid object.

FIG. 4 shows a front view of the back plate assembly 2, without the fastening bands 6 attached.

FIG. 5 shows a cross-section of the ball-joint 23 which shows threads 40, allowing the truck 20 to screw into the ball 21 and shows how the ball-joint 23 screws into the arm segments 24 or some other supporting means.

Having thus described my invention I claim:

1. A universally positionable book holder comprising a selectively shaped back plate having a frontal lip at its lower portion, projecting peg means extending from a lower portion of said back plate, a plurality of spaced projecting peg means extending from and along an upper portion of said back plate;

hold-down means in the form of stays pivotably mounted near the top of said back plate;

attachment means on the back of said back plate for attachment to support means.

2. A device according to claim 1 in which elastic band means are affixed to the projecting peg means extending from the lower portion of said back plate, which band means may be stretchably secured to any of the plurality of spaced projecting peg means extending from and along the upper portion of the back plate.

3. A device according to claim 1 in which a universally positionable support means is attached to the attachment means on the back of said back plate.

4. A device according to claim 3 wherein said universally positionable support means comprise:

ball means, affixed to the back plate and mounted within socket means, said ball and socket comprising ball joint means;

said ball joint means affixed to a first arm segment;

said first arm segment rotatably attached to a first swivel;

said first swivel attached to a second joint means;

said second joint means attached to a second swivel means;

said second swivel means rotatably attached to a second arm segment;

said second arm segment attached to a third swivel means;

said third swivel means being attached to a third joint means;

said third joint means attached to a post;

said post being attached to mounting means.

5. A device according to claim 4 in which the mounting means comprises a base assembly having both clamp means and screw hole means.

6. A universally positionable book holder comprising:

a selectively shaped plate of generally rectangular shape, having:

a length designed to be parallel to a spine of a book to be held, and a width, perpendicular thereto; and having:

a front, a back, and along its elongated dimension:

a lower end, and an upper end;

the lower end being indented on its right and left sides slightly from the width;

a frontal lip proturuding from the lower end;

a "T" shaped peg protruding from each side, right and left, of the lower indentions, the "T"s' being formed coplanar to the plate with the "T"s' bottoms oriented toward the longitudinal center of the plate;

elastic bands capable of being affixed to said pegs by looping a bight of each band through another bight of said band around the stem of the "T" in the fashion of a fisherman's bend;

the upper end also being indented on its right and left sides slightly from the width;

a plurality of "T" shaped pegs protruding from the right and left sides of the upper end indentations, the "T"s being formed coplanar to the plate with the "T"s' bottoms oriented toward the longitudinal center of the plate;

hold down means in the form of stays pivotably mounted near the top of said plate, said stays forming flat planes in their untensioned state;

attachment means on the back of said plate for attachment to support means comprising a threaded screw means;

ball means, affixed to plate and mounted within socket means, said ball and socket comprising ball joint means;

said ball joint means affixed to a first arm segment;

said first arm segment rotatably attached to a first swivel;

said first, swivel attached to second joint means;

said second joint means attached to a second swivel means;

said second swivel means rotatably attached to a second arm segment;

said second arm segment attached to a third swivel means;

said third swivel means being attached to a third joint means;

said third joint means attached to a post;

said post being attached to a fourth swivel means;

said fourth swivel means being attached to a mounting means;

said mounting means having both clamp means and screw hole means of being fastened to a surface.

* * * * *